United States Patent [19]

Taylor

[11] 4,042,105

[45] Aug. 16, 1977

[54] SAFETY CLOSURE FOR A CONTAINER AND METHOD FOR OPENING THE CLOSURE

[76] Inventor: Clarence R. Taylor, 28 Woodside Drive, Penfield, N.Y. 14526

[21] Appl. No.: 700,584

[22] Filed: June 28, 1976

[51] Int. Cl.[2] ..... B65D 43/16; B65D 55/02

[52] U.S. Cl. ..... 206/1.5; 215/209; 215/224; 220/281; 220/307; 206/807

[58] Field of Search ..... 206/1.5, 807; 215/209, 215/214, 224; 220/281, 306, 307

[56] References Cited

U.S. PATENT DOCUMENTS

| | | | |
|---|---|---|---|
| 3,790,015 | 2/1974 | Imamura | 215/209 |
| 3,907,103 | 9/1975 | Shaw | 206/1.5 |

*Primary Examiner*—George T. Hall

[57] ABSTRACT

A safety closure for a container which is very difficult or virtually impossible for a child to open but can be easily opened by an adult. The safety closure and container are preferably integrally molded as one piece, and the closure comprises a cap adapted to be secured to the opening of the container by a snap-latch. The cap is released from the container by an inclined ramp on the container adjacent the outer periphery of a rim on the cap. In the method for opening the safety closure, the leading end of the inclined ramp is manually pressed inwardly by a thumb or the like toward the center of the cap and underneath the cap rim. While in this position, the thumb is progressively slid along the container causing the inclined ramp on the container to progressively cam the cap upwardly overcoming the snap-latch and releasing the cap.

11 Claims, 19 Drawing Figures

SAFETY CLOSURE FOR A CONTAINER AND METHOD FOR OPENING THE CLOSURE

BACKGROUND OF THE INVENTION

1. Field of the Invention

This invention relates generally to safety closures, and more specifically to an improved safety closure for a container, vial, or the like and method for opening the closure that is very difficult or virtually impossible for a child to practice.

2. Description of the Prior Art

The great advances made in the field of medicine have been accompanied by a tremendous growth in the variety and types of drugs or medicines available to and stocked by members of the public. Many of these drugs, which are normally dispensed in small capped bottles, are beneficial when taken in the proper recommended dosage, but may be exceedingly dangerous if consumed in quantities that are too large. The simple aspirin tablet, which may be helpful for alleviating headaches, is a good example of such a drug. Also, medicinal liquids are available on the market that may be safe if applied to various parts of the human body, but may be exceedingly dangerous or poisonous if taken internally. The availability of the aforementioned medicinal drugs to small children, who are unaware of the potential danger of these drugs, presents a hazard and threat to their lives. In this day and age, young children are more exposed to such potentially dangerous drugs than at any other time in history. Since the cap normally used on containers for drugs is of the common threaded, screw-on type, it is not difficult for most young children to be able to open these containers and to partake of the contents thereof. It is virtually impossible for adults to sufficiently tighten such caps so that they cannot be removed by a child. Applicant's invention is believed to eliminate the aforementioned potential danger to children by providing a safety closure for a container which an adult may readily open or close, but once closed may not be readily opened by a child.

Safety closures for containers are well known in the art and of varied design ranging from the type in which a cap must be depressed downwardly and removed, or downwardly and turned, to the type in which the cap is removed by thumb pressure exerted upwardly on the cap or by a pull tab integral with the cap. One safety closure comprises an injection molded polypropylene cap with lugs that mesh with notches in the container. The cap is removed by pressing downwardly, preferably with the palm of a hand and simultaneously turning the cap to disengage the lugs from the notches. Other two-piece safety closures are known having a ring rotatably mounted on a container for receiving a cap. The cap is turned or rotated in a cap-tightening direction to a fully tightened position in which rotation of the cap in a cap removing direction merely causes the cap and ring member to rotate together around the rim of the container. The cap is removed by manually arresting the ring and then turning the cap in a cap removing direction. Safety closures of this general type are disclosed in U.S. Pat. Nos. 3,403,803 and 3,486,654.

Another type of safety closure is known of which U.S. Pat. No. 3,850,326 is exemplary comprising a closure having a snap-on lid adapted to open and close the opening and retained in its closed position to give the appearance of the top of the closure. The closure has a portion on its outer surface which is displaceable inwardly to allow a finger of the user to remove the snap-on lid. The displaceable portion is not readily distinguishable from the remainder of the closure.

Although these prior known safety closures operate satisfactorily, many of them are not air and liquid tight which is a desirable feature. In addition, most of them comprise two or more molded parts which have to be assembled resulting in closures that are expensive to manufacture and of questionable reliability. In addition, although most of the safety closures provide a challenge to a child they can be opened since they generally rely on pressure applied at one point, or turning, or a lifting action which are natural actions for a child.

SUMMARY OF THE INVENTION

In accordance with a preferred embodiment of the invention, an improved safety closure is disclosed for a container, vial or the like containing pills or liquid which may be deleterious to the health of a child. The safety closure and container are preferably molded as a single piece comprising a container mouth and an integral cap for closing the mouth opening. The cap is releasably held in its closed position by a snap-latch. In an improved method for overcoming the latch and releasing the closure cap, the mouth of the container is provided with means such as an inclined ramp which is initially manually pressed inwardly by a thumb or the like toward the center of the cap. While in such inward position, manual pressure is progressively applied by sliding a thumb along the periphery of the container mouth causing the ramp to cam the cap upwardly releasing the latch.

In another embodiment of the invention, the safety closure is separate from container and is provided with means for securing the closure to the mouth of standard containers.

In still another modification of the invention, the safety closure is provided with a small orifice and a depending nipple on the cap for opening and closing the orifice.

One advantage of this invention is to provide an improved safety closure for a container or the like that is very difficult or virtually impossible for a child to open since it combines a pressing action with a sliding action. Another advantage of this invention is to provide an improved safety closure that is of simple design and construction, highly reliable and inexpensive to manufacture. The invention and these and other advantages will become more apparent from the detained description of the preferred embodiments presented below.

BRIEF DESCRIPTION OF THE DRAWING

In the detailed description of the preferred embodiments of the invention presented below, reference is made to the accompanying drawing, in which.

DESCRIPTION OF THE PREFERRED EMBODIMENTS

Figure 4:
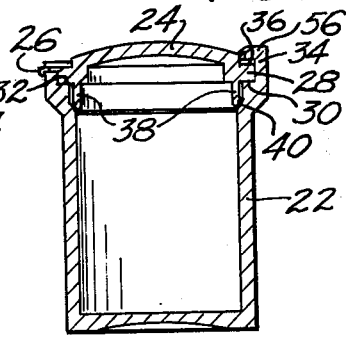
FIG. 4 is a section view taken substantially along line 4—4 of FIG. 3.

With reference to FIGS. 1-4, a preferred embodiment of the safety closure 20 of this invention is disclosed in relation to a container 22. Although the container and closure are of a circular cross-section, it should be understood that they could be constructed of any suitable cross section. The container 22 and cap 24 of the closure are integrally molded as one piece from any suitable flexible material such as plastic with the cap secured to the container by what is known in the art as a living hinge 26. Cap 24 has a peripheral rim 28 having a lower surface 30 for engaging an annular seat 32 when the cap is pressed into a closed position as seen in FIG. 4. Cap 24 is releasably held in its closed position by a snap-latch of known type comprising a flexible finger 34 on the container which is initially cammed outwardly by cap rim 28 as the cap is pressed to its closed position, and then returns to its original position due to its resilience engaging the upper surface 36 of rim 28. Cap 24 is further provided with a depending skirt 38 for slideably engaging an inclined shoulder 40 on the container to provide a liquid seal for preventing any liquid held in the container from leaking out.

With reference to FIGS. 5-12, the improved means for releasing cap 24 will be described. The outer peripheral surface 42 of rim 28 snugly fits within the inner peripheral surface 44 of the container for approximately two-thirds of its circumference. However, with reference to FIGS. 3, 5, 7 and 8, container 22 is provided with an arcuate recess 46 (FIGS. 2 and 3) adjacent outer peripheral surface 44 of the corresponding portion of rim 42 for the remainder of its circumference. The lower surface of recess 46 forms an inclined ramp 48 (FIG. 5) starting from the level of seat 32 and extending upwardly to the top surface 58 of the container.

Figure 1:
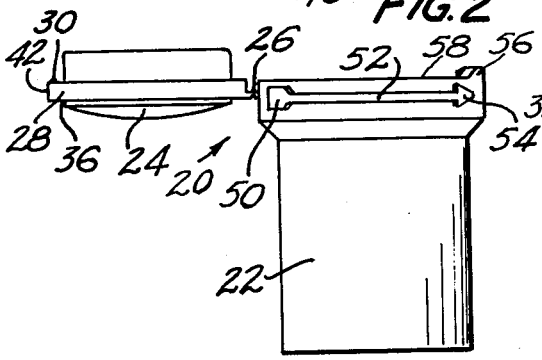
FIG. 1 is a side elevational view of a preferred embodiment of the safety closure of this invention for a container and shown in an open position.
Figures 6, 7, 8, 9, 10, 11, 12:
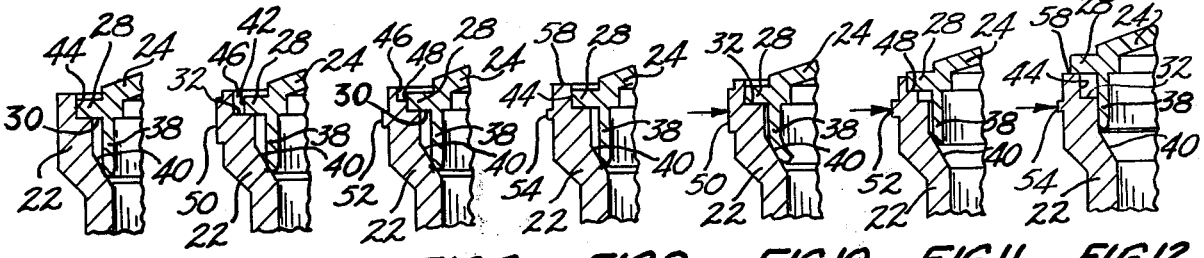
FIGS. 6-9 are enlarged segmental section views taken substantially along lines 6—6, 7—7, 8—8 and 9—9 respectively of FIG. 3.
FIG. 10 is a view similar to FIG. 7 with the container wall pressed inwardly.
FIG. 11 is a view similar to FIG. 8 with the container wall pressed inwardly and the closure cap partially released.
FIG. 12 is a view similar to FIG. 9 with the container wall still pressed inwardly and the cap released from the container.

In practising the method for releasing cap 24, the portion of the container illustrated in FIG. 7 (section 7—7 of FIG. 3) is manually pressed radially inwardly by a thumb or the like into the depressed position illustrated in FIG. 10. The point of pressure application corresponds to the tail 50 of an arrow 52 molded on the outer surface of the container as best seen in FIG. 1 to indicate where the pressure should be applied and the direction in which the thumb or the like is moved. The directions to open the closure such as the words "squeeze along arrow to open" can be inscribed on the top of the cap or on any other suitable place on the container. While maintaining the inward depressed position and pressure, the thumb is slid progressively around container 22 in the direction of arrow 52 causing inclined ramp 48 to progressively engage the lower surface 30 of the cap and to cam it upwardly from the container as seen in FIGS. 11 and 12. When the thumb reaches the head 54 of arrow 52, the force exerted upwardly by the inclined ramp 48 is sufficient to overcome the flexible latch finger 34 causing the cap rim 28 to slip past the end of finger 34.

Figure 2:
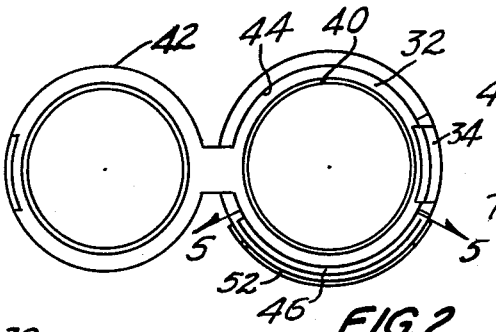
FIG. 2 is a top plan view of FIG. 1.
Figure 3:
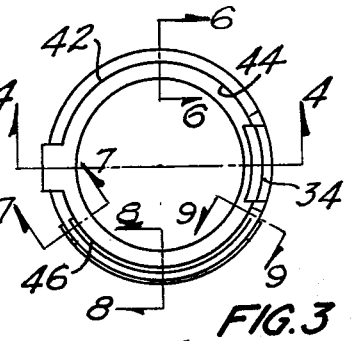
FIG. 3 is a top plan view of the safety closure of FIGS. 1 and 2 shown in a closed position.
Figure 13:
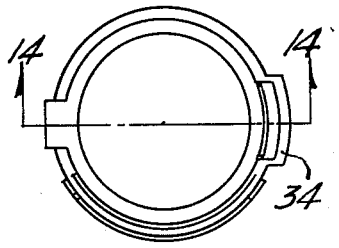
FIG. 13 is a top plan view similar to FIG. 3 of a modified safety closure and container.
Figure 14:
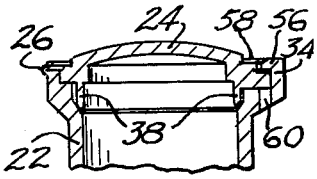
FIG. 14 is a segmental section view taken substantially along line 14—14 of FIG. 13.
Figure 5:
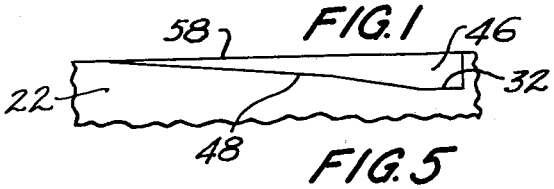
FIG. 5 is a segmental enlarged side elevational view of the ramp means for opening the cap taken substantially from line 5—5 of FIG. 2.
Figure 15:
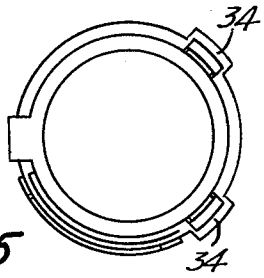
FIG. 15 is a top plan view similar to FIG. 13 of a modified safety closure and container.

In FIGS. 13 and 14 of the drawing, a modification of the safety closure is disclosed in which the container latch finger 34 is extended radially outwardly a greater distance than in FIG. 4 to provide more locking engagement. This is achieved by a mold insert extending through a slot 60 in the container. In addition, the upper surface 56 of flexible finger 34 by this arrangement is substantially at the same level as the upper surface 58 of the container. One disadvantage of this embodiment is that liquid poured out of the container in the latch area might escape through slot 60. FIG. 15 discloses a further modification in which a pair of spaced apart latch fingers 34 are provided to overcome this objection by allowing the liquid to be poured from the container at a point between slots 60.

Figure 16:
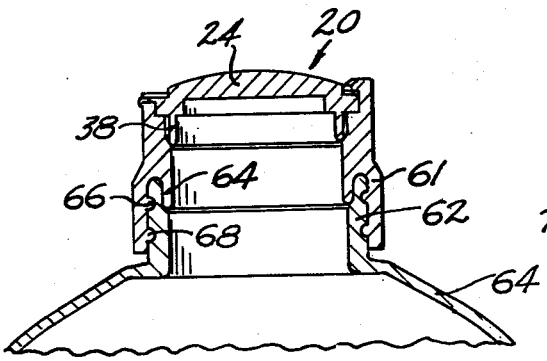
FIGS. 16, 17 and 18 are segmental views in section of safety closures of this invention mounted on the necks of any suitable standard containers.
Figure 17:
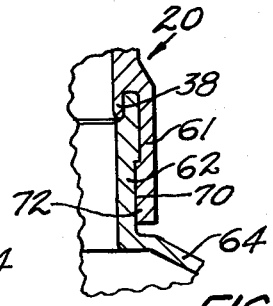
Figure 18:
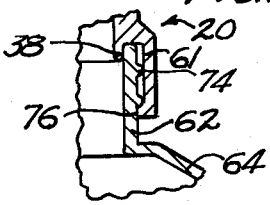

With reference to FIGS. 16, 17 and 18, several modifications of a safety closure 20 is disclosed in which the closure is not integral with a container. The lower end 61 of the closure form a sleeve which is rigidly secured by a press fit to a neck 62 of standard containers 64 on the market. Lower end 61 has a flexible skirt 64 to cooperate with neck 62 to provide a liquid seal. In FIG. 16 the neck 62 of the container is provided with annular grooves 66 for receiving corresponding ribs 68 on the closure. In FIG. 17, container neck 62 is provided with a wide recess 70 for receiving a corresponding wide rib 72 on the closure. In FIG. 18, container neck 62 is provided with a spiral thread 74 and closure 20 is provided with a rib 76 gripping the lowermost thread 74 of the container.

Figure 19:
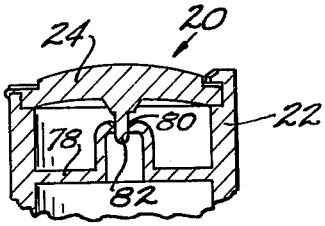
FIG. 19 is a segmental view in a section of a further modification to the safety closure of this invention.

With the reference to FIG. 19, another modification of safety closure 20 is illustrated in which the closure and/or container is provided with an integral plate or membrane 78 spanning the opening and provided with a small central orifice 80. Such a closure is desirable for those applications in which it is desired to dispense only a small amount or stream of liquid. Cap 24 is provided with a central depending nipple 82 which extends through orifice 80 and seals the container when the cap is closed.

The invention has been described in detail with particular reference to preferred embodiments, but it will be understood that modifications and variations can be effected within the spirit and scope of the invention as described.

What is claimed is:

1. A safety closure for a container comprising:
a flexible body member having an opening;
a seat on said body member surrounding said opening;
a cap having a bottom surface mountable on said seat for closing said opening;
means on said cap and body member for releasably securing said cap on said seat; and
cam means on said body member adapted, when manually moved by a force toward and underneath said bottom surface to a depressed position and the force progressively applied while in said depression position along the length of said cam means, to cam said cap out of said seat against the bias of said securing means.

2. The safety closure according to claim 1 wherein said cam means has a leading end, an inclined ramp, and a trailing end, and said leading end is initially moved to said depressed position underneath said bottom surface, and while said leading end is in said depressed position said inclined ramp is progressively moved underneath said bottom surface up to and including said trailing end.

3. The safety closure according to claim 2 wherein said body member has a plate across said opening, said plate having an orifice, and said cap has a depending nipple insertable into said orifice for closing said orifice when said cap is mounted on said body member.

4. The safety closure according to claim 1 wherein said bottom surface lies in a plane when said cap is mounted on said body member, said cam means comprises an inclined ramp having a leading end lying substantially in said plane and a trailing end spaced above said plane.

5. The safety closure according to claim 4 wherein said cap further has a side surface substantially perpendicular to said bottom surface, and said inclined ramp is adjacent said side surface when said cap is mounted on said seat.

6. The safety closure according to claim 1 wherein said bottom surface of said cap lies in a plane when said cap is mounted on said body member, said cap further having a side surface substantially perpendicular to said bottom surface, said seat comprises a groove surrounding said opening for receiving said side and bottom surfaces of said cap, and said body member further has a recess adjacent a portion of said side surface and cam means in said recess comprising an inclined ramp concentric with and adjacent to said side surface when said cap is mounted on said body member, said inclined ramp having a leading end lying substantially in said plane and a trailing end spaced above said plane.

7. The safety closure according to claim 6 wherein said body member has a plate across said opening, said plate having an orifice, and said cap has a depending nipple insertable into said orifice for closing said orifice when said cap is mounted on said body member.

8. The safety closure according to claim 6 wherein said body member has an inner annular sealing shoulder below said groove, and said cap has a flexible cylindrical skirt depending from said bottom surface for sealingly engaging said shoulder when said cap is mounted on said body member.

9. The safety closure according to claim 8 wherein said flexible body member is integral with a container.

10. The safety closure according to claim 8 wherein the container has a neck forming said opening, and said flexible body member is secured to said neck.

11. A method for removing the latched cap of a safety closure from a container comprising the steps of:

manually depressing the wall of the container inwardly by a thumb of the like to a depressed position causing the leading end of an inclined ramp adjacent the outer surface of the cap to move underneath the lower surface of the cap; and while said wall is in said depressed position;

sliding the thumb progressively around the container from the leading end of the ramp to its trailing end causing the ramp to cam the cap upwardly overcoming the latch and removing the cap from the container.

* * * * *